United States Patent [19]

Adams

[11] Patent Number: 4,937,703

[45] Date of Patent: Jun. 26, 1990

[54] CIRCUIT FOR DRIVING A RELAY WITH PROTECTION AGAINST CONTACT DEGRADATION

[75] Inventor: John T. Adams, Minneapolis, Minn.

[73] Assignee: Honeywell Inc., Minneapolis, Minn.

[21] Appl. No.: 282,723

[22] Filed: Dec. 12, 1988

[51] Int. Cl.[5] ..... H01H 47/00

[52] U.S. Cl. ..... 361/187; 361/160; 361/170

[58] Field of Search ..... 361/160, 170, 171, 185, 361/186, 187, 3

[56] References Cited

U.S. PATENT DOCUMENTS

| | | | |
|---|---|---|---|
| 3,670,209 | 6/1972 | Hensen | 361/195 |
| 4,153,922 | 5/1979 | Azuma et al. | 361/3 |
| 4,276,483 | 6/1981 | Hayden | 307/10.1 |
| 4,423,765 | 1/1984 | Hildebrand | 307/265 |
| 4,745,515 | 5/1988 | Fowler | 361/185 |
| 4,769,737 | 9/1988 | Ogita et al. | 361/203 |
| 4,833,284 | 5/1989 | Park | 361/185 |

*Primary Examiner*—A. D. Pellinen
*Assistant Examiner*—Jeffrey A. Gaffin
*Attorney, Agent, or Firm*—Mitchell J. Halista

[57] ABSTRACT

A relay driver circuit which protects a relay against contact degradation. A detector circuit within the relay driver circuit receives an AC signal at a random phase. The detector circuit correspondingly provides a detector signal to a threshold responsive circuit, such as a timer, which drives the relay. The threshold responsive circuit responds substantially the same to a detector signal provided on a positive cycle and to a detector signal provided on a negative cycle. The relay driver circuit is applied to control a blower fan in an air conditioning system.

14 Claims, 3 Drawing Sheets

CIRCUIT FOR DRIVING A RELAY WITH PROTECTION AGAINST CONTACT DEGRADATION

BACKGROUND OF THE INVENTION

The invention relates to relays which switch AC power to a load. More particularly, the invention relates to a relay driver circuit which prevents relay contact degradation.

The potential across and current flowing between the contacts of a relay when they open and close cause the migration of melted or ionized contact material from one contact to the other. The direction of material migration depends upon the polarity established across the relay contacts at the time when they open or close. If the polarity across the contacts at the instant they open or close is consistently in the same direction, contact degradation results since one of the contacts repetitively gives up material while the other contact repetitively accumulates material. The relay can eventually malfunction due to contact pitting which causes mechanical welding.

The above-described degradation of a relay occurs in several applications. One such application involves air conditioning systems wherein a timer delay circuit is used to operate a blower fan while the compressor is on and to keep it operating for a pre-determined period of time following compressor shut-off. The operation of the blower fan after compressor shut-off allows higher energy efficiency of the air conditioning system.

A thermostat controls the operation of the air conditioning system. When the thermstat switches to its "on" mode in response to a temperature rise, an AC signal, typically 24 volts, is switched to actuate the compressor. This AC signal is also switched to a trigger input of the delay timer. The delay timer is triggered on a positive cycle of the AC signal when the voltage is above a certain threshold. When the delay timer is triggered, its output turns on and causes the energizing of a relay, which correspondingly closes an AC circuit consisting of the blower fan.

When the temperature lowers and causes the thermostat to turn off, the AC signal is not provided to actuate the compressor or to trigger the delay timer. As a result, the compressor shuts off, while the fan continues to operate until the predetermined time delay of the timer has elapsed. When the time has elapsed, typically 80 seconds in this application, the output of the delay timer shuts off which deenergizes the relay coil. Consequently, the AC circuit providing power to the fan is turned off.

The AC signal switched by the thermostat and provided to the delay timer is synchronized in frequency with the AC source operating the fan. The switching of the thermostat is independent of the phase of the AC signal. However, since the delay timer is triggered upon only a positive cycle of the AC signal, the relay controlling operation of the fan closes its contacts repetitively on the same portion of a cycle of the AC source. The closing of the relay contacts consistently on a positive cycle or on a negative cycle results in contact degradation.

As a result, an inexpensive method to alleviate the contact degradation occurring in this application is desired. Methods have been devised which protect a relay from contact degradation. In one method, a relay is actuated when a control signal reaches a certain DC threshold. However, since the control signal also consists of an AC line voltage component, the threshold voltage is reached repetitively during the positive cycles of the AC line voltage. Contact degradation occurs as a result. To prevent the relay contacts from closing repetitively on a positive cycle of the line voltage, a separate signal generating circuit is used to generate a timing signal which has a cycle longer than, and being asynchronous with, the AC line voltage. In order to close the relay, a specified combination of both the generated timing signal and the control signal must be present. This dependence on the asynchronous timing signal consequently results in the relay to close at random times with respect to the phase of the AC line voltage.

However, applying this method to alleviate the problem associated with the air conditioning system would be overly expensive and complex. The present invention provides an inexpensive method for protecting a relay from contact degradation when applied to systems similar to that of the air conditioning system.

SUMMARY OF THE INVENTION

A relay driver circuit is disclosed which provides means for protecting a relay against contact degradation. A detector circuit within the relay driver circuit receives an AC signal at a random phase. The detector circuit correspondingly provides a detector signal to a threshold responsive circuit, such as a timer, which drives the relay. The threshold responsive circuit responds substantially the same to a detector signal provided on a positive cycle and to a detector signal provided on a negative cycle. The relay driver circuit disclosed is applied to control a blower fan in an air conditioning system.

DESCRIPTION OF THE INVENTION

Figure 1:
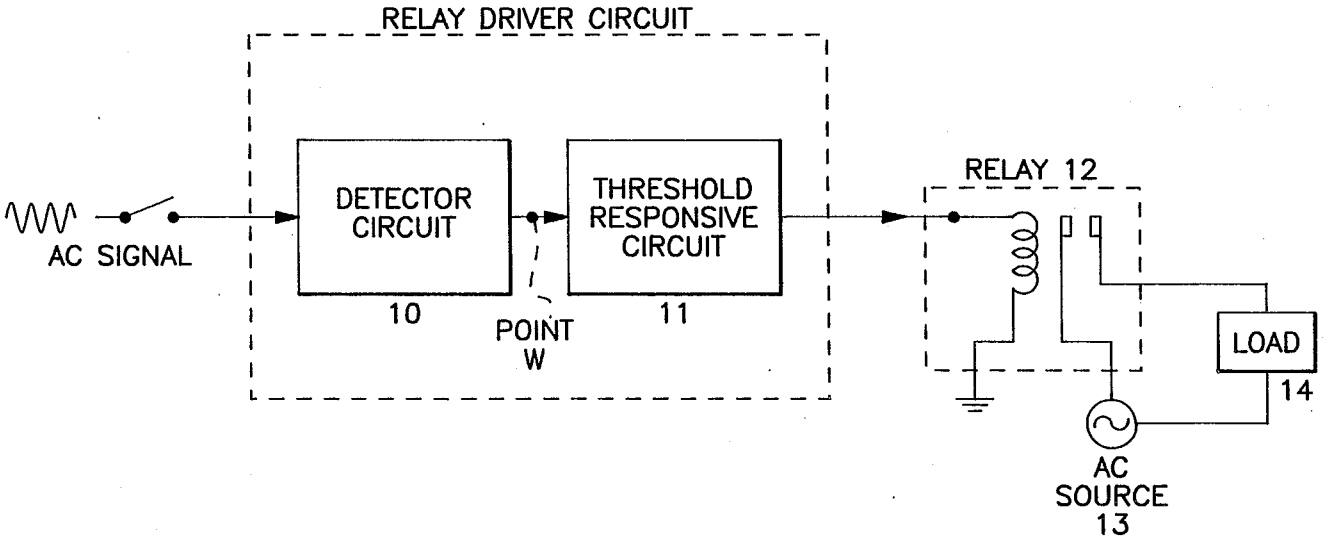
FIG. 1 shows a block diagram of a relay driver circuit wherein protection against relay contact degradation is provided.

Referring to FIG. 1, a block diagram of a relay driver circuit is shown. A detector circuit 10 is connected to receive an AC signal which is switched to the detector circuit 10 at a random phase. The detector circuit 10 provides a detector signal at point W during periods of both the positive and negative cycle of the switched AC signal. The detector signal is capable of triggering, energizing, or charging a threshold responsive circuit 11 which drives the coil of a relay 12. When the relay 12 contacts close, an AC circuit having an AC source 13, whose frequency is synchronized with the switched AC signal, is closed to provide AC power to a load 14.

Since the detector circuit 10 provides a detector signal during periods of both a positive and a negative cycle of the switched AC signal, and the threshold responsive circuit 11 responds equally or substantially equally to a detector signal provided during a positive cycle and to a detector signal provided during a negative cycle, protection against relay contact degradation is provided thereby.

The AC signal switched at a random phase to the detector circuit 10 could be provided as the result of a variety of switching means. A parameter sensitive device such as a thermostat or a humidistat could switch the AC signal to the detector circuit 10. Alternatively, a manual switch could switch the AC signal to the detector circuit 10. It is apparent that the present invention could be applied to applications involving these or other switching means without departing from the spirit of the invention.

Figure 2:
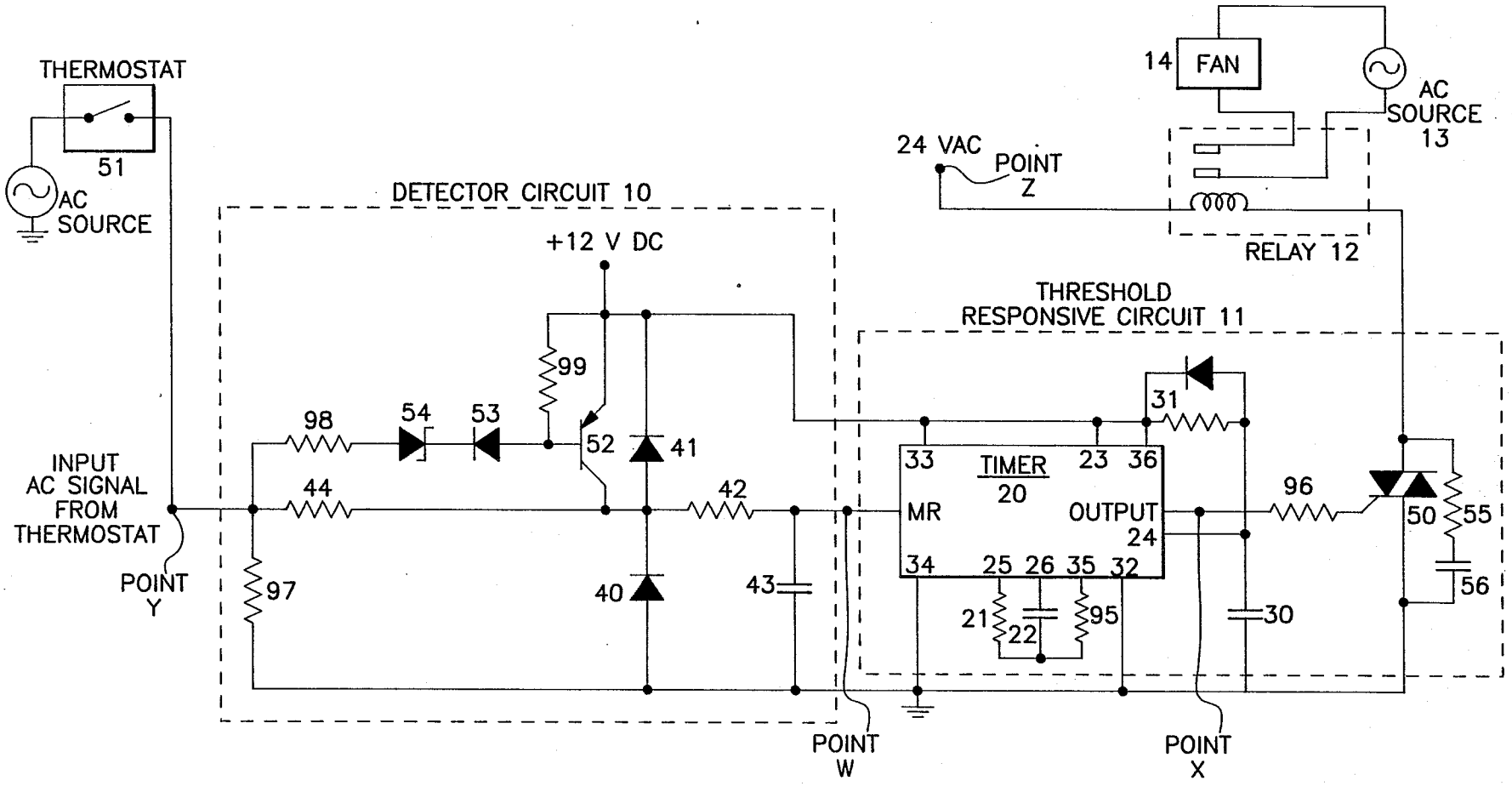
FIG. 2 is a schematic diagram of the preferred embodiment of the present invention providing a timing circuit for driving a relay with protection against relay contact degradation.

Referring next to FIG. 2, the preferred embodiment of the present invention is shown as applied in a fan controller of an air conditioning system. The threshold responsive circuit 11 used in this application is a timing circuit which consists of a delay timer 20. The timer 20, such as a Motorola MC14541B programmable timer, is connected to receive the detector signal at its Master Reset (MR) terminal at point W and provide an output signal at its output terminal shown at point X. When the Master Reset terminal goes "high", the output goes "high". When the Master Reset goes "low", the timer 20 begins its timing sequence as determined by the resistor 21, the capacitor 22, and the inputs at the A input terminal 23 and the B input terminal 24. The output terminal returns to "low" after the timing sequence is complete.

The timing circuit is set up to provide the time delay desired. In this example, the resistor 21 and capacitor 22 have been selected to provide an oscillating rate of approximately 411 Hertz. The resistor 21 is connected to the $R_{tc}$ input terminal 25 and the capacitor 22 is connected to the $C_{tc}$ input terminal 26. The A input terminal 23 is selected to be "high", while the B input terminal 24 is initially "low" at power-up but goes to "high" when the capacitor 30 charges due to source current through the resistor 31. In addition, the mode is selected to single cycle mode, as determined by the input at terminal (32). The power supply is connected between terminal (33) and terminal (34).

The detector circuit 10 is shown with its output connected at point W to the Master Reset terminal of the timer circuit and its input at point Y connected to receive the 24 volt, 60 Hertz thermostat signal. The diode 40 limits the negative voltage level at its cathode to above approximately −0.7 volts, and the diode 41 limits the positive voltage level at the same point to below approximately 12.7 volts. In addition, the time constant of the RC network provided by resistor 42 and capacitor 43 is relatively fast with respect to the 60 Hertz signal in order to eliminate the effects of transients on the timer.

When the thermostat is in the "off" mode, no signal is applied to the detector input at point Y. When there is no signal at point Y, the Master Reset of timer 20 is "low".

When the thermostat switches to the on mode, a 24 volt, 60 Hertz signal is applied to the detector circuit 10 at point Y. The phase of the signal at the instant the thermostat switches is random since the thermostat switching is a function of temperature and independent of the phase of the 24 volt signal.

If the phase of the 24 volt thermostat signal at the instant when the thermostat switches "on" is such that its voltage level is positive and above a certain threshold, a direct electrical path to trigger the Master Reset is provided through resistors 44 and 42 and capacitor 43. This path is referred to as the positive cycle signal path. When capacitor 43 charges, the resulting positive voltage appearing at the Master Reset terminal resets or triggers the timer 20, causing the timer 20 output to go "high" at point X. A "high" voltage at the timer output turns on the triac 50 which consequently completes an electrical path for current to flow from the 24 volt AC source at point Z, through the relay 12 winding and triac 50 to ground.

The current flowing through the relay 12 winding causes the relay 12 contacts to close which consequently completes a circuit which turns on the blower fan 14. The direction of the current flow at the instant when the relay 12 contacts close depends upon the phase of the line voltage from the AC source 13 when the contacts close. Since the phase of the AC source 13 voltage driving the fan is synchronized with the phase of the detector input signal at point Y, the direction of current flow through the relay 12 contacts is dependent upon the phase of the detector input signal at the instant when the timer 20 is reset.

If the phase of the 24 volt detector input signal at the instant when the thermostat 51 turns on is such that its voltage is negative and below a certain threshold, another signal path is provided to reset the timer 20. The emitter of transistor 52 is biased at 12 volts. This bias results in a voltage of approximately 11.3 volts at its base and a corresponding voltage of 10.6 volts at the cathode of diode 53 when current is allowed to flow. The Zener diode 54 becomes conductive when a reverse biased voltage drop of 14 volts is across it. Hence, when the voltage at the anode of Zener diode 54 is below approximately −3.4 volts, the transistor 52 turns on. When the transistor 52 turns on, current flows from the 12 volt bias supply, through the emitter to collector of transistor 52, through the resistor 42, and through capacitor 43. Consequently, a positive voltage is charged across capacitor 43 which resets the timer 20. The signal path provided here is referred to as the negative cycle signal path. Again in this case, when the timer 20 is reset, the output at point X goes "high" which fires the triac 50 on, and correspondingly, energizes the relay 12.

After the thermostat 51 turns "on" and causes the timer 20 to reset on either a positive or negative cycle of the detector input signal, the Master Reset will return to low when the signal phase changes and nears a zero voltage level crossing, causing capacitor 43 to discharge. When the Master Reset goes from "high" to "low", the timing sequence is initiated. However, if the thermostat 51 remains "on" such that the thermostat signal is still applied at the detector input (point Y), the Master Reset returns to high, or is retriggered, due to each successive half cycle of the thermostat signal. Since the programmed delay of the timer is approximately 80 seconds and is much longer than the retriggering rate at the Master Reset, the output of the timer 20 remains "high" which consequently sustains the energization of the relay 12.

When the thermostat 51 turns "off" due to a change in air temperature, the Master Reset again goes "low" and is not retriggered as long as the thermostat 51 is "off". The timing sequence of the timer 20 begins, while the output at point X remains high for 80 seconds. After 80 seconds, the timing sequence of the timer 20 is complete and the output at point X goes "low", which correspondingly turns off the triac 50 and deenergizes the relay 12. The deenergization of the relay 12 causes its contacts to open and correspondingly shut off the blower fan 14.

The Series RC circuit consisting of the resistor 55 and capacitor 56 across the triac 50 eliminates the effects of transients which could cause false triggering of the triac 50.

Hence, the preferred embodiment of the present invention shown in FIG. 2 provides protection against relay contact degradation where a threshold responsive circuit, such as the timer 20, is used to drive a relay. Since the threshold responsive circuit can be triggered upon only a positive voltage level, a detector circuit is used to detect the presence of the input AC signal and to trigger the threshold responsive circuit on both positive and negative cycles of the AC signal.

Figure 3:
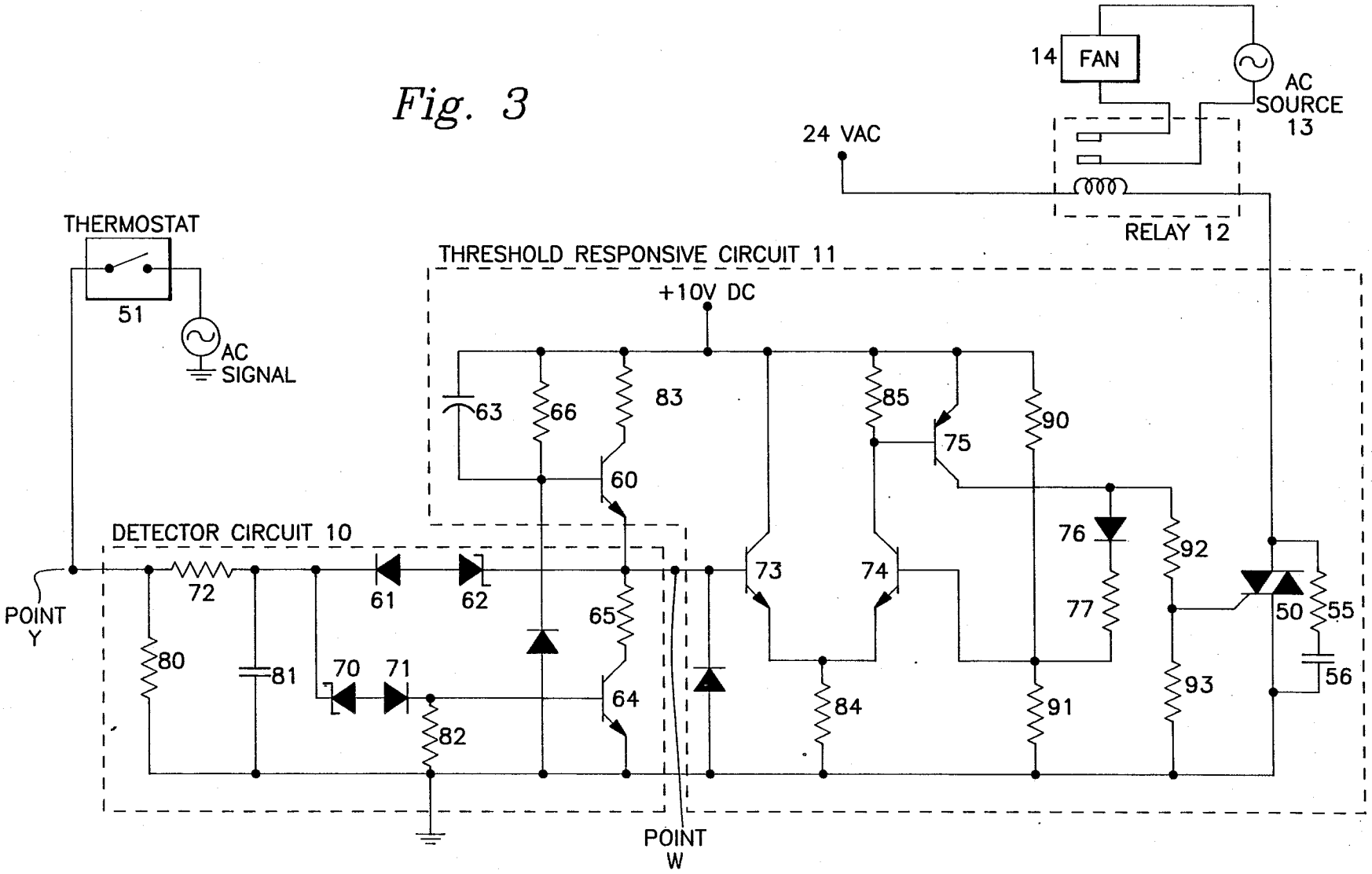
FIG. 3 is a schematic diagram of an alternative relay driver circuit providing a similar function as that provided by the preferred embodiment of FIG. 2.

Referring next to FIG. 3, another embodiment of the invention is shown. The detector circuit 10 receives an AC signal from the thermostat 51 at point Y and provides alternate paths, a positive cycle signal path and a negative cycle signal path, by which the thermostat signal can turn on transistor 60. The threshold responsive circuit 11 provides a timing function similar to that of the preferred embodiment of FIG. 2.

When the AC voltage from the thermostat 51 is sufficiently negative, the biasing of transistor 60 and diodes 61 and 62 allows current to flow through the capacitor 63, through transistor 60, and through diodes 61 and 62.

When the AC voltage from the thermostat 51 is sufficiently positive, the base of transistor 64 is forward biased, causing the transistor to turn on. Correspondingly, transistor 60 turns on, allowing current to flow through the capacitor 63, the transistor 60, the resistor 65, and the transistor 64 to ground.

The time constant established by the RC network, consisting of capacitor 63 and resistor 66, and either the positive or negative cycle signal paths is such that the capacitor 63 does not charge to its capacity on a single half cycle of the detector input signal. Hence, as the capacitor 63 gains charge on each successive half cycle, the voltage at point W decreases from its original value (of approximately 9.3 volts) to decreasingly lower values.

If the time constant determined by the positive cycle signal path consisting of diodes 70 and 71, transistor 64, and resistor 65 and the RC network of capacitor 63 and resistor 66 is substantially equal to the time constant determined by the negative cycle charging path of diodes 61 and 62, resistor 72, and the RC network, then the voltage at point W will decrease uniformly on both a positive and negative cycle of the detector input signal.

When the voltage at point W decreases below a certain threshold, transistor 73 turns off and transistor 74 turns on. Consequently, transistor 75 turns on, causing the triac 50 and the relay 12 to turn on. The diode 76 and resistor 77 results in hysteresis control to the comparator function provided by the differential pair of transistors 73 and 74. Hence, as long as the thermostat signal is applied to the input of the detector circuit 10 at point Y, the capacitor 63 remains charged and the relay 12 remains energized.

Since the triggering of the differential pair 73 and 74, as determined by the charging of capacitor 63, is equally likely to occur on both a positive or a negative half cycle of the thermostat signal, protection against contact degradation of the relay 12 is provided.

When the thermostat 51 turns off, virtually no current flows through the emitter of transistor 60. Thus, capacitor 63 discharges slowly due to the relatively high resistance path provided by resistor 66. In turn, the voltage at point W slowly rises. After approximately 80 seconds, the voltage is sufficiently high to overcome the raised threshold voltage established by the hysteresis provided to the differential pair comparator. Consequently, transistor 73 turns on and transistor 74 turns off. When transistor 74 turns off, transistor 75 and the triac 50 turn off, resulting in the deenergization of the relay 12. In addition, the hysteresis provided to the base of transistor 74 returns to its low voltage level.

Since the triggering of the differential pair 73 and 74, as determined by the charging of capacitor 63, is equally likely to occur on both a positive or a negative half cycle of the thermostat signal, protection against contact degradation of the relay 12 is provided.

The component values chosen for the circuits of FIGS. 2 and 3 are as folows:

| NUMBER DESIGNATOR | TYPE AND VALUE |
|---|---|
| 21 | Resistor, 22.5K ohm |
| 22 | Capacitor, .047 μF |
| 30 | Capacitor, 2.2 μF |
| 31 | Resistor, 2M ohm |
| 42 | Resistor, 10K ohm |
| 43 | Capacitor, .1 μF |
| 44 | Resistor, 10K ohm |
| 54 | Zener Diode, 15 volt |
| 55 | Resistor, 10 ohm |
| 56 | Capacitor, .02 μF |
| 62 | Zener Diode, 5 volt |
| 63 | Capacitor, 47 μF |
| 65 | Resistor, 3K ohm |
| 66 | Resistor, 1.18M ohm |
| 70 | Zener Diode, 5 volt |
| 72 | Resistor, 10K ohm |
| 77 | Resistor, 30.9K ohm |
| 80 | Resistor, 680 ohm |
| 81 | Capacitor, .1 μF |
| 82 | Resistor, 10K ohm |
| 83 | Resistor, 20K ohm |
| 84 | Resistor, 20K ohm |
| 85 | Resistor, 10K ohm |
| 90 | Resistor, 61.9K ohm |
| 91 | Resistor, 61.9K ohm |
| 92 | Resistor, 1.2K ohm |
| 93 | Resistor, 10K ohm |
| 95 | Resistor, 200K ohm |
| 96 | Resistor, 1.2K ohm |
| 97 | Resistor, 680 ohm |
| 98 | Resistor, 10K ohm |
| 99 | Resistor, 10K ohm |

While the foregoing specification describes a preferred embodiment of the invention, other embodiments will be apparent to those skilled in the art, without departing from the spirit of the invention which is limited only by the following claims:

I claim:

1. A relay driver circuit connected to receive an AC signal at a random phase and to drive the excitation coil of a relay which has at least two contacts which make or break an AC circuit, the relay driver circuit comprising:

a detector circuit receiving the AC signal at a random phase and providing a detector signal during certain phase periods of the AC signal; and a threshold responsive circuit connected to receive said detector signal of said detector circuit and adapted for providing an output signal to drive the excitation coil of the relay in response to said detector signal whereby protection against degradation of the relay contacts is provided, wherein said detector circuit provides said detector signal during periods of a positive cycle of said AC signal and during periods of a negative cycle of said AC signal.

2. The relay driver circuit according to claim 1 wherein said detector circuit comprises:

a positive cycle signal path for providing said detector signal during periods of a positive cycle of the AC signal; and a negative cycle signal path for providing said detector signal during periods of a negative cycle of the AC signal.

3. The relay driver circuit according to claim 2 wherein said negative cycle signal path comprises an active element responsive to the AC signal to provide said detector signal during periods of a negative cycle of the AC signal.

4. The relay driver circuit according to claim 3 wherein said active element comprises a comparator.

5. The relay driver circuit according to claim 3 wherein said active element comprises a transistor.

6. The relay driver circuit of claim 5 wherein said threshold responsive circuit responds substantially the same to said detector signal during periods of a negative cycle and during periods of a positive cycle of the AC signal.

7. The relay driver circuit of claim 1 wherein said threshold responsive circuit comprises a timing circuit responsive to said detector signal for providing an output signal to drive the excitation coil of the relay in response to said detector signal.

8. The relay driver circuit of claim 7 wherein said timing circuit comprises an integrated circuit timer.

9. The relay driver circuit of claim 8 wherein said timing circuit is triggered by said detector signal during periods of both a positive and negative cycle of the AC signal.

10. The relay driver circuit of claim 1 wherein said threshold responsive circuit comprises an RC circuit which charges in response to said detector signal.

11. The relay driver circuit of claim 1 wherein said threshold responsive circuit comprises:

an RC circuit which charges in response to said detector signal; and a threshold comparator means responsive to the charging of said RC circuit for providing said output signal to drive the excitation coil of the relay when a certain threshold voltage is charged across said RC circuit.

12. The relay driver circuit of claim 11 wherein said RC circuit charges substantially the same during a positive cycle of the AC signal and during a negative cycle of the AC signal.

13. The relay driver circuit of claim 12 wherein said threshold responsive circuit comprises a comparator means to sense the charging of said RC circuit.

14. The relay driver circuit of claim 13 wherein said comparator means consists of a transistor differential pair.

* * * * *